US006848242B2

(12) United States Patent
Chang et al.

(10) Patent No.: US 6,848,242 B2
(45) Date of Patent: Feb. 1, 2005

(54) PIVOTED EQUESTRIAN BIT WITH STOP SYSTEM

(76) Inventors: Hsi-Chang Chang, 15 F-C 447, Sec. 3, Wen-Shin Road, Taichung (TW); Nelson Pessoa, Haras de Lignv 1, rue duPont De Lignv Fleurs (BE), B-6220; Rodrigo Fessca, Haras de Lignv. 1, Rue duPont De Lignv Fleuds (BE), B-6220

( * ) Notice: Subject to any disclaimer, the term of this patent is extended or adjusted under 35 U.S.C. 154(b) by 0 days.

(21) Appl. No.: 10/487,559

(22) PCT Filed: Aug. 30, 2001

(86) PCT No.: PCT/IB01/02884

§ 371 (c)(1),
(2), (4) Date: Feb. 24, 2004

(87) PCT Pub. No.: WO03/018403

PCT Pub. Date: Mar. 6, 2003

(65) Prior Publication Data

US 2004/0200196 A1 Oct. 14, 2004

(51) Int. Cl.[7] ..... B68B 1/06
(52) U.S. Cl. ..... 54/9
(58) Field of Search ..... 54/7, 8, 9

(56) References Cited

U.S. PATENT DOCUMENTS 87,281 A 2/1869 Nixon
212,935 A * 3/1879 Holland et al. ..... 54/8
290,803 A * 12/1883 Scherling ..... 54/8
709,700 A 9/1902 Drown

FOREIGN PATENT DOCUMENTS

DE 25455 2/1883
GB 27164 3/1911

* cited by examiner

*Primary Examiner*—Robert P. Swiatek
(74) *Attorney, Agent, or Firm*—Antonio R. Durando; Quarles & Brady Streich Lang LLP

(57) ABSTRACT

A bit (10) includes a mouthpiece (12) having two mouthpiece members (20). Each of the mouthpiece members has an end (**20*a*,20*b*) which faces the other mouthpiece member, and the two ends are connected to one another by a joining arrangement comprising (26**) one or more pivots and a stop system. The stop system limits the relative angular displacement of the mouthpiece members from a reference position towards the rear of a horse. In the reference position, the joining arrangement and the two ends of the mouthpiece members connected by the arrangement lie approximately along a straight line. The stop system prevents relative angular displacement of the mouthpiece members from the reference position towards the rear of the horse or limits the relative angular displacement in this direction to a minor fraction of the maximum possible relative angular displacement of the mouthpiece members from the reference position towards the front of the horse.

10 Claims, 6 Drawing Sheets

PIVOTED EQUESTRIAN BIT WITH STOP SYSTEM

BACKGROUND OF THE INVENTION

1. Field of the Invention

The invention relates to an equestrian bit.

2. Description of the Prior Art

It is desirable to control the behavior of a horse while mounted thereon, and a rider must have the ability to control the direction, speed and gait of the horse. The most effective device for providing this control is a bit, and such a bit includes a mouthpiece which is inserted in the mouth of the horse. The mouthpiece can be rigid as is the case for a Mullen mouthpiece or the mouthpiece can alternatively be jointed.

When a mouthpiece is properly positioned in the mouth of a horse, an end of the mouthpiece protrudes from either side of the horse's mouth. Each of these ends is connected to a large ring or the like called a cheek. The cheeks are used to connect the mouthpiece to reins which generally are long leather straps extending from the mouth of the horse to the hands of the rider. Typically, when the rider wishes to slow or stop the horse, the rider pulls the reins backwards causing the cheeks to pull the mouthpiece towards the rider. The pressure of the mouthpiece in the mouth of the horse induces the horse to change its current behavior, and the horse usually slows or stops.

A bit can be used for purposes other than slowing or stopping a horse. Thus, a bit can be used to control the direction of a horse; to induce a horse to move backwards; to encourage a horse to raise and/or lower its head; and to signal a horse to rear up on its back legs. A horse's response to a bit is determined by the manner in which the horse is trained. For example, some horses are trained to respond to a greater pull on one rein than the other. An unequal pull on the reins causes the pressure on one side of a bit to exceed the pressure on the other side and a horse responds by turning its head or its body to the side with the greater pressure. Other horses are trained not to respond to unequal pressure on a bit but, rather, to a rein placed on one side of the neck or the other.

For a horse, the insertion of a bit in the mouth is not a natural occurrence. The ability of a bit to control a horse is due, in large part, to the discomfort provided by the bit or the memory of the discomfort provided by a previous bit. A horse will initially reject and attempt to expel a bit from its mouth and must therefore be trained to accept and respond to the bit.

To this end, it is customary to train a horse to accept a bit by using a bit in which the mouthpiece is not rigid. Bits of this type, which are referred to as "jointed mouthpiece" bits, include a mouthpiece having two members which are pivotally connected to one another. The mouthpiece members are pivotable relative to one another through 180 degrees in two opposite directions from a position in which the mouthpiece members lie on a straight line.

A jointed mouthpiece bit allows a horse to move the bit to a more comfortable position within its mouth and is primarily used to accustom the horse to the feeling of a bit. An additional benefit of a jointed mouthpiece bit is that it is not as likely as a rigid bit to injure an untrained horse. However, with this increase in comfort and safety for the horse comes a corresponding decrease in the ability to control the behavior of the horse.

Once a horse has become accustomed to a jointed mouthpiece bit in its mouth, it is customary to progress to a bit with a rigid mouthpiece. A rigid mouthpiece bit can be safely used only on horses which have been trained to accept a bit, and the transition from a jointed mouthpiece bit to a rigid mouthpiece bit is difficult. Thus, just as a horse will initially resist having a bit of any type placed in its mouth, the horse will resist the progression from a jointed mouthpiece bit to a rigid mouthpiece bit since a rigid mouthpiece bit is far less comfortable than a jointed mouthpiece bit.

SUMMARY OF THE INVENTION

It is an object of the invention to ease acceptance of a rigid mouthpiece by a horse.

The preceding object, as well as others which will become apparent as the description proceeds, are achieved by the invention.

One aspect of the invention resides in an equestrian mouthpiece. An embodiment of the mouthpiece comprises a first member for insertion in the mouth of a horse and a second member for insertion in the mouth of a horse. The first member has a first end while the second member has a second end. The instant embodiment of the mouthpiece further comprises means for joining the first end and the second end to one another. The joining means includes pivot means mounting the mouthpiece members for pivotal movement relative to each other in a first direction from a position in which the pivot means, the first end of the first member and the second end of the second member lie substantially along a straight line. The joining means also includes stop means for preventing or limiting relative pivotal movement of the mouthpiece members from the straight-line position in a second direction opposite to the first direction. The stop means is arranged so that relative angular displacement of the mouthpiece members from the straight-line position in the second direction is restricted to at most a minor fraction of the maximum possible relative angular displacement of the mouthpiece members from the straight-line position in the first direction.

The mouthpiece of the invention is designed to be inserted in the mouth of a horse in an orientation such that the stop means becomes operative when a rider pulls on at least one of the reins. In this orientation, the mouthpiece members can undergo a certain amount of relative pivotal movement from the straight-line position towards the front of the horse but only a fraction of this amount of relative pivotal movement, or no relative pivotal movement, from the straight-line position towards the rear of the horse.

The mouthpiece of the invention possesses characteristics of both a conventional jointed mouthpiece and a conventional rigid mouthpiece. With slack reins, the mouthpiece of the invention resembles a conventional jointed mouthpiece in that the mouthpiece members can undergo a certain amount of relative pivotal movement. This allows any discomfort which may be caused by the mouthpiece of the invention to be reduced. On the other hand, when the reins are pulled back and urge the mouthpiece members to pivot towards the rear of the horse, the stop means brakes the mouthpiece members when these assume predetermined positions. The mouthpiece of the invention now resembles a conventional rigid mouthpiece since the mouthpiece members are essentially fixed against further pivotal movement.

The mouthpiece of the invention can be used as a transition from a conventional jointed mouthpiece to a conventional rigid mouthpiece. Thus, the mouthpiece of the invention can adjust when the reins are slack so as to reduce discomfort but can feel like a rigid mouthpiece when the reins are taut. Consequently, once the horse has become accustomed to the mouthpiece of the invention, it is relatively easy for the horse to accept a completely rigid mouthpiece.

Another aspect of the invention resides in a method of making an equestrian mouthpiece. The method comprises the steps of fabricating a first member for insertion in the mouth of a horse, fabricating a second member for insertion in the mouth of a horse, and fashioning means for joining a first end of the first member to a second end of the second member. The step of fashioning the joining means includes forming pivot means for allowing pivotal movement of the first and second members relative to one another in a first direction from a position in which the pivot means, the first end and the second end lie substantially along a straight line. The step of fashioning the joining means further includes forming stop means for preventing or limiting relative pivotal movement of the first and second members from the straight-line position in a second direction opposite to the first direction. The stop means is designed so that relative angular displacement of the first and second members from the straight-line position in the second direction is restricted to at most a minor fraction of the maximum possible relative angular displacement of the first and second members from the straight-line position in the first direction.

According to one embodiment of the instant method, the step of fashioning the joining means may involve forming a first element which defines an opening having a maximum width and forming a second element which has an arcuate portion designed to pass through the opening. The arcuate portion is formed with a first section and a second section, and the first section constitutes part of the pivot means and has a thickness smaller than the maximum width of the opening while the second section constitutes part of the stop means and has a thickness greater than such maximum width.

In one variation of the present embodiment, the step of fashioning the joining means comprises forming one of the first element and the second element on the first mouthpiece member and forming the other of the first element and the second element on the second mouthpiece member.

According to another variation of the instant embodiment, the step of fashioning the joining means comprises fabricating an additional mouthpiece member designed to be located between the first mouthpiece member and the second mouthpiece member. The step of fashioning the joining means may then further comprise forming one of the first element and the second element on the first mouthpiece member, and forming the other of the first element and the second element on the additional mouthpiece member.

In the variation under consideration, the step of fashioning the joining means can comprise forming two additional elements. The additional elements include a first additional element which defines an additional opening having an additional maximum width and a second additional element which has an additional arcuate portion designed to pass through the additional opening. The additional arcuate portion is formed with a first section and a second section, and the first section constitutes part of the pivot means and has a thickness smaller than the maximum width of the additional opening while the second section constitutes part of the stop means and has a thickness greater than such maximum width. The step of fashioning the joining means may involve forming one of the first additional element and the second additional element on the second mouthpiece member and forming the other of the first additional element and the second additional element on the additional mouthpiece member.

According to another embodiment of the instant method, the step of fashioning the joining means comprises forming a shoulder and a tongue for abutting the shoulder. The tongue and the shoulder constitute, or constitute part of, the stop means.

In the present embodiment, the step of fashioning the joining means may further comprise forming a pivot pin which constitutes, or constitutes part of, the pivot means. The present embodiment of the method can then comprise the additional step of mounting the shoulder and the tongue on the pivot pin for pivotal movement relative to and into abutment with one another.

Considering still the embodiment with the shoulder and the tongue, the step of fashioning the joining means may involve the production of a slot. The shoulder can here be formed in the slot, and the step of mounting the shoulder and the tongue on the pivot pin may include passing the pivot pin through the slot and the tongue.

According to an additional embodiment of the instant method, the step of fashioning the joining means comprises forming a pair of tabs for abutting one another. The tabs constitute, or constitute part of, the stop means.

In the embodiment under consideration, the step of fashioning the joining means may further comprise forming a tubular element and a shaft which constitute, or constitute part of, the pivot means. The step of fashioning the joining means may also comprise making one of the tabs fast with the tubular element and the other of the tabs fast with the shaft. An additional step in the present embodiment of the method can involve mounting the tubular element on the shaft so that the tubular element and the shaft are rotatable relative to one another.

With continued reference to the embodiment with the tubular element and the shaft, the step of fashioning the joining means may comprise forming a first cylindrical element with one of the tabs and a second cylindrical element with the other of the tabs. The cylindrical elements constitute, or constitute part of, the stop means. This embodiment of the method can further comprise the steps of fixing the first cylindrical element in the tubular element and fixing the second cylindrical element on the shaft.

According to the instant embodiment, the step of fashioning the joining means can comprise fabricating an additional mouthpiece member designed to be located between the first mouthpiece member and the second mouthpiece member. The step of fashioning the joining means may then further comprise forming the tubular element on one of the first mouthpiece member and the additional mouthpiece member and forming the shaft on the other of the first member and the additional mouthpiece member.

In the present embodiment, the step of fashioning the joining means can involve forming an additional tubular element and an additional shaft which constitute, or constitute part of, the pivot means. The step of fashioning the joining means can also involve forming a pair of additional tabs for abutting one another, and one of the additional tabs may be made fast with the additional tubular element while the other of the additional tabs may be made fast with the additional shaft. The additional tabs constitute, or constitute part of, the stop means. The additional tubular element can be formed on one of the second mouthpiece member and the additional mouthpiece member whereas the additional shaft can be formed on the other of the second mouthpiece member and the additional mouthpiece member. The embodiment under consideration may then additionally comprise the step of mounting the additional tubular element on the additional shaft so that the additional tubular element and the additional shaft are rotatable relative to one another.

A further aspect of the invention resides in a method of operating an equestrian mouthpiece having a first mouthpiece member with a first end, a second mouthpiece member with a second end and means joining the first end and the second end to one another. The joining means includes pivot means mounting the first mouthpiece member and the second mouthpiece member for pivotal movement relative to each other in a first direction from a position in which the pivot means, the first end and the second end lie substantially along a straight line. The method of operating the mouthpiece comprises the steps of inserting the mouthpiece in the mouth of a horse, and restricting relative angular displacement of the first mouthpiece member and the second mouthpiece member from the straight-line position in a second direction opposite to the first direction. The relative angular displacement is restricted to at most a minor fraction of the maximum possible relative angular displacement of the first mouthpiece member and the second mouthpiece member from the straight-line position in the first direction.

In accordance with one embodiment of the instant method, the step of restricting the relative angular displacement of the first mouthpiece member and the second mouthpiece member may include catching a section of a first element in an opening of a second element. The method can here further comprise the step of pivoting the first mouthpiece member and the second mouthpiece member relative to one another by rotating the first element and the second element relative to each other.

According to another embodiment of the method under consideration, the step of restricting the relative angular displacement of the first mouthpiece member and the second mouthpiece member can involve abutting a tongue of one element with a shoulder of another element. This embodiment of the method may additionally comprise the step of pivoting the first mouthpiece member and the second mouthpiece member relative to one another on an axis passing through the tongue.

In an additional embodiment of the present method, the step of restricting the relative angular displacement of the first mouthpiece member and the second mouthpiece member comprises abutting a first tab with a second tab.

Other features and advantages of the invention will be forthcoming from the following detailed description of preferred embodiments when read in conjunction with the accompanying drawings.

DESCRIPTION OF THE PREFERRED EMBODIMENTS

Figure 1:
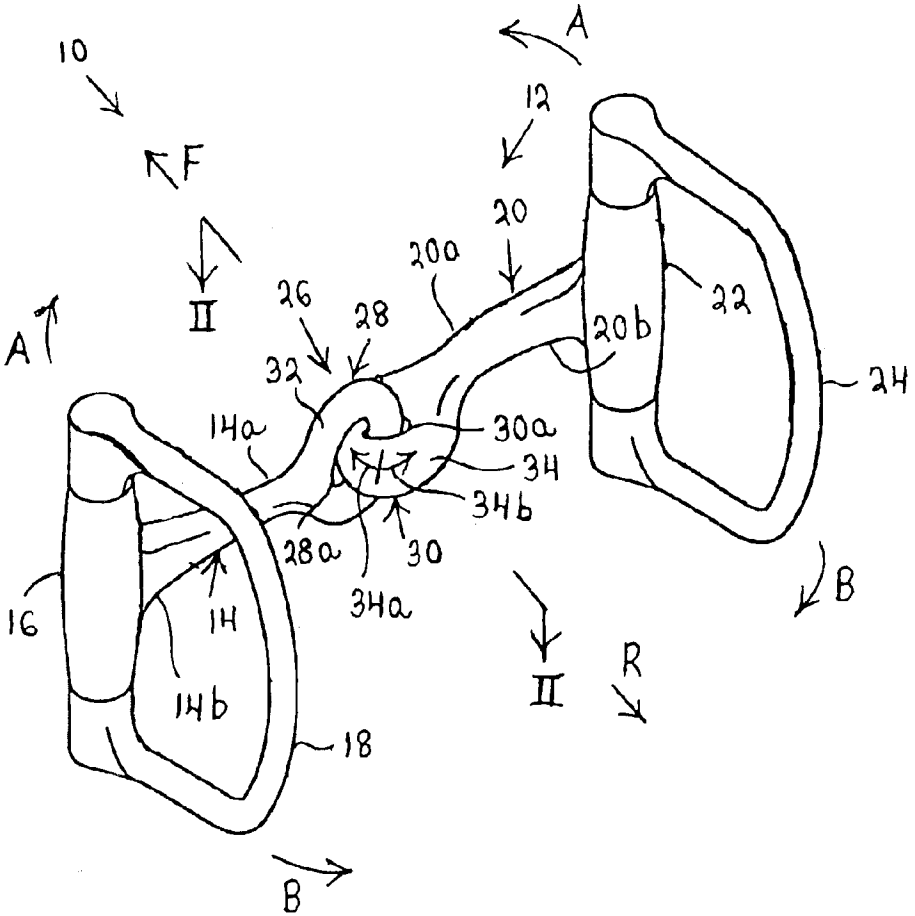
FIG. 1 is a perspective view of a bit containing one embodiment of a mouthpiece according to the invention.

Referring to FIG. 1, the numeral 10 generally identifies a bit according to the invention. The bit 10 includes a mouthpiece 12 which is designed to be inserted in the mouth of a horse in order to control the horse.

The mouthpiece 12 comprises an elongated mouthpiece member 14 having opposite longitudinal ends 14*a* and 14*b*. The end 14*b* carries a tube 16, and a cheek 18 is pivotally mounted on the tube 16 in a conventional manner. The tube 16 has a longitudinal axis, and such axis serves as a pivot axis for the cheek 18.

The mouthpiece 12 further comprises an additional elongated mouthpiece member 20 having opposite longitudinal ends 20*a* and 20*b*. The end 20*b* carries a tube 22, and a cheek 24 is pivotally mounted on the tube 22 in a conventional manner. The tube 22 has a longitudinal axis, and such axis serves as a pivot axis for the cheek 24.

The cheeks 18,24 are adapted to be connected to respective reins which are used by the rider of a horse to control the horse.

The longitudinal end 14*a* of the mouthpiece member 14 and the longitudinal end 20*a* of the mouthpiece member 20 are connected to one another by a joining system or joining means 26. The joining system 26 includes two interlocking rings or annular elements 28 and 30, and the ring 28 is of one piece with the longitudinal end 14*a* of the mouthpiece member 14 while the ring 30 is of one piece with the longitudinal end 20*a* of the mouthpiece member 20.

The ring 28 comprises an at least approximately annular rod-like or bar-like portion 32 which runs circumferentially of the ring 28 and defines a circular opening 28*a*. Similarly, the ring 30 comprises an at least approximately annular rod-like or bar-like portion 34 which runs circumferentially of the ring 30 and defines a circular opening 30*a*. The annular portion 32 of the ring 28 passes through the opening 30*a* in the ring 30 while the annular portion 34 of the ring 30 passes through the opening 28*a* in the ring 28.

The ring 28 is symmetrical or nearly so. Thus, the annular portion 32 of the ring 28 has a uniform diameter or thickness along the entire, or almost the entire, circumference of the ring 28. Hence, the opening 28*a* of the ring 28 is centered, or nearly centered, in the ring 28. The diameter or thickness of the annular portion 32 is smaller than the diameter or maximum width of the opening 30*a* in the ring 30. This allows the rings 28,30 to pivot or rotate relative to one another.

Figure 2:
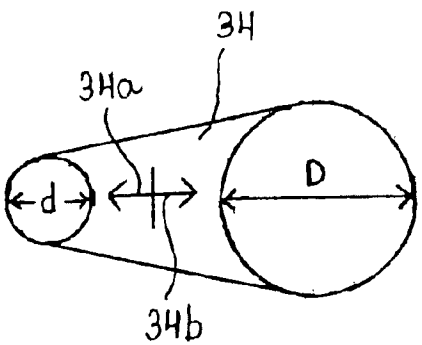
FIG. 2 is an enlarged sectional view in the direction of the arrows II—II of FIG. 1 of a ring forming part of the mouthpiece of FIG. 1.

In contrast to the ring 28, the ring 30 is asymmetrical as illustrated in the sectional view of the ring 30 in FIG. 2. Considering FIG. 2 in conjunction with FIG. 1, it will be observed that the diameter or thickness of the annular portion 34 of the ring 30 varies circumferentially of the ring 30. Depending upon the orientation of the ring 30, the diameter or thickness of annular portion 34 of the ring 30 increases progressively from a minimum value "d" to a maximum value "D" when proceeding clockwise or counterclockwise around the ring 30. Accordingly, the opening 30*a* of the ring 30 is off-center in the ring 30.

The annular portion 34 of the ring 30 includes a thinner section 34*a* which runs partway along the circumference of the ring 30 and a thicker section 34*b* which also runs partway along the circumference of the ring 30. The diameter or thickness of the annular portion 34 everywhere along the thinner section 34*a* is smaller than the diameter or width of the opening 28*a* in the ring 28. On the other hand, the diameter or thickness of the annular portion 34 everywhere along the thicker section 34*b* is equal to or greater than the diameter or width of the opening 28*a* in the ring 28. By virtue of this design of the ring 30, the rings 28,30 can pivot or rotate relative to one another as long as the ring 28 is not urged against the thicker section 34*b* of the ring 30. In contrast, when the ring 28 is urged into abutment with the thicker section 34*b*, relative rotation of the rings 28,30 is prevented.

The thinner section 34*a* of the ring 30 constitutes, or constitutes part of, a pivot system or pivot means for pivoting or rotating the rings 28,30 relative to each other. On the other hand, the thicker section 34*b* constitutes, or constitutes part of, a stop system or stop means for preventing or limiting relative rotation of the rings 28,30.

Considering FIG. 1, it is assumed that the bit 10 is located in the mouth of a non-illustrated horse. The arrow R denotes a direction from the bit 10 towards the rear of the horse while the arrow F denotes a direction from the bit 10 towards the front of the horse. When the bit 10 is properly positioned in the mouth of the horse as in FIG. 1, the ring 30 has a generally horizontal orientation and the thicker section 34*b* of the ring 30 faces the rear of the horse.

In FIG. 1, the mouthpiece 12 of the bit 10 is in a reference position in which the longitudinal end 14*a* of the mouthpiece member 14, the longitudinal end 20*a* of the mouthpiece member 20 and the rings 28,30 joining the ends 14*a*,14*b* to one another lie at least approximately along a straight line.

From the reference position or straight-line position, the mouthpiece members 14,20 are free to pivot relative to each other towards the front of the horse, as denoted by the arrows A, through a substantial angle. The maximum possible relative angular displacement of the mouthpiece members 14,20 towards the front of the horse will depend upon the design of the bit 10 but will normally be between 90 degrees and 180 degrees.

In contrast, relative pivotal movement of the mouthpiece members 14,20 from the reference position towards the rear of the horse, denoted by the arrows B, is restricted by the stop system including the thicker section 34*b* of the ring 30. The possible relative angular displacement of the mouthpiece members 14,20 towards the rear of the horse will depend upon the design of the bit 10. Thus, the mouthpiece members 14,20 may be prevented from undergoing any relative pivotal movement towards the rear of the horse so that the possible relative angular displacement of the mouthpiece members 14,20 in this direction is zero degrees. On the other hand, the mouthpiece members 14,20 may be allowed to undergo limited relative pivotal movement towards the rear of the horse. In such an event, the maximum possible relative angular displacement of the mouthpiece members 14,20 towards the rear of the horse will be a minor fraction, i.e., less than one-half, of the maximum possible relative angular displacement towards the front of the horse.

The mouthpiece 12 of the bit 10 exhibits the characteristics of both a conventional jointed mouthpiece and a conventional rigid mouthpiece. Thus, similarly to a conventional jointed mouthpiece, the mouthpiece members 14,20 of the mouthpiece 12 have considerable freedom to pivot relative to one another towards the front of the horse. On the other hand, the mouthpiece 12 resembles a conventional rigid mouthpiece in that the mouthpiece members 14,20 form a rigid, or almost rigid, structure when the ring 28 is urged against the thicker section 34*b* of the ring 30. This will occur when a rider on the horse exerts sufficient pull on the reins.

As long as the reins are slack, the mouthpiece members 14,20 of the mouthpiece 12 can pivot relative to each other through a substantial angle from the reference position towards the front of the horse. Like a conventional jointed mouthpiece, this allows any discomfort which may be caused by the mouthpiece 12 to be reduced. When the reins are taut, the mouthpiece members 14,20 are no longer able to pivot relative to one another and the mouthpiece 12 has the feel of a conventional rigid mouthpiece to the horse.

As outlined earlier, a horse must typically be trained to accept a bit since the presence of a hard object in the mouth is unnatural for the horse. A bit with a conventional jointed mouthpiece is used initially because such a bit is adjustable to reduce any discomfort which may be caused by the bit. In this type of bit, there are two mouthpiece members which have virtually unlimited freedom to pivot relative to one another. Once the horse has become accustomed to a bit with a conventional jointed mouthpiece, current practice is to switch to a conventional bit with a completely rigid mouthpiece inasmuch as this gives a rider greater control. The switch is traumatic for the horse which abruptly experiences a change from almost total freedom of adjustment to virtually no possibility of adjustment.

One object of the invention is to ease the transition from an almost fully adjustable bit to an essentially rigid bit.

The bit 10 of the invention allows this object to be attained. Thus, since the bit 10 leaves a horse some room for adjustment but yet can provide the feel of a completely rigid bit, the bit 10 constitutes an intermediate stage between an almost fully adjustable bit and an essentially rigid bit. Consequently, if a horse in training is switched from an almost fully adjustable bit to the bit 10 and then from the bit 10 to an essentially rigid bit, the transition from the almost fully adjustable bit to the essentially rigid bit will be significantly easier on the horse than a transition from the almost fully adjustable bit directly to the essentially rigid bit.

Figure 3:
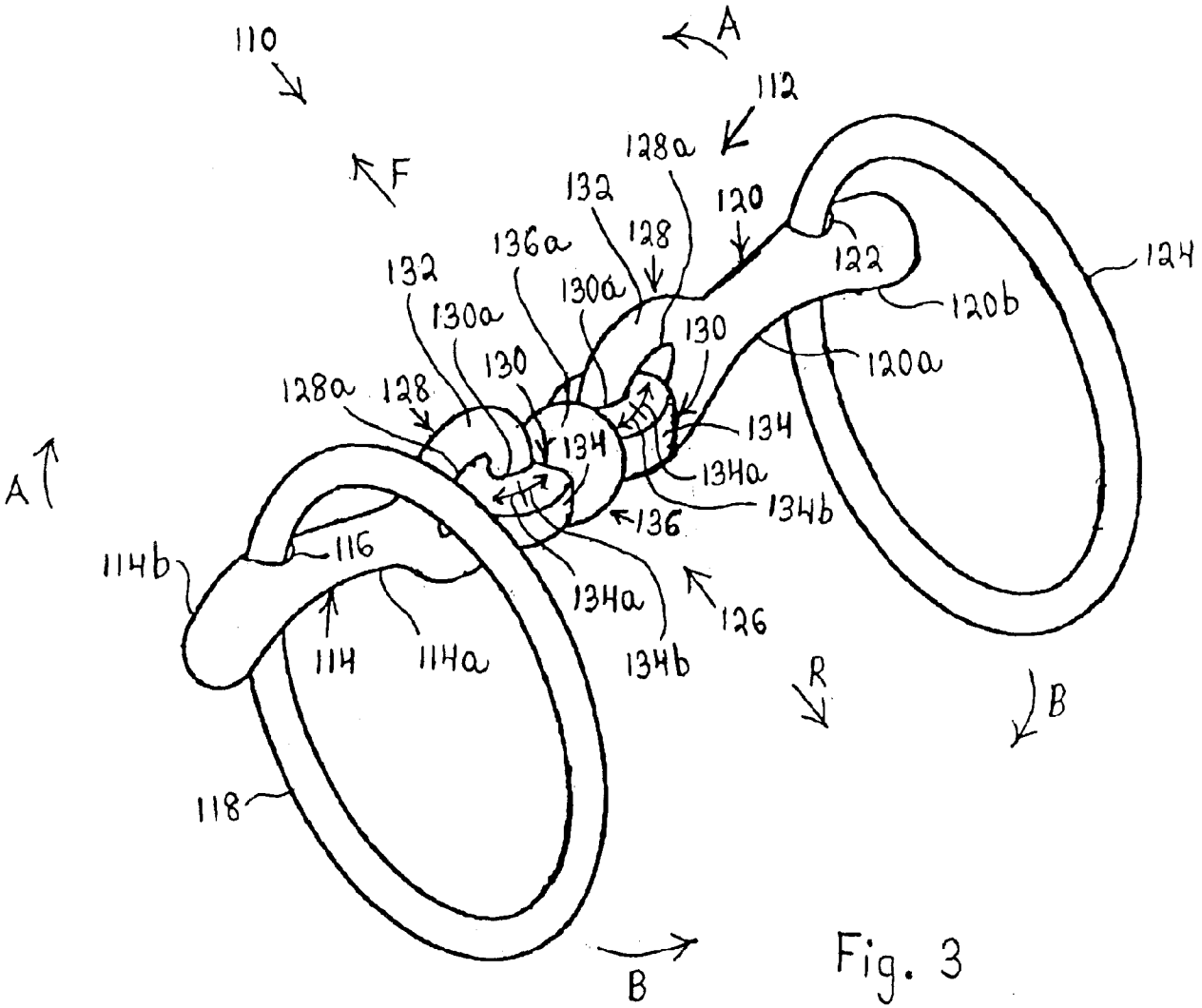
FIG. 3 is a perspective view of a bit containing another embodiment of a mouthpiece in accordance with the invention.

In FIG. 3, which shows another embodiment of a bit in accordance with the invention, the same letters as in FIG. 1 have the same meaning. Moreover, the same numerals as in FIGS. 1 and 2, plus 100, denote similar elements.

The bit 110 of FIG. 3 differs from the bit 10 of FIG. 1 in several respects. To begin with, the mouthpiece members 114,120 have a somewhat different configuration than the mouthpiece members 14,20. Furthermore, the tube 16 of FIG. 1 has been replaced by an aperture 116 near the longitudinal end 114*b* of the mouthpiece member 114 while the tube 22 has been replaced by an aperture 122 near the longitudinal end 120*b* of the mouthpiece member 120. The cheeks 118,124 of FIG. 3, which are shaped differently than the cheeks 18,24 of FIG. 1, are respectively anchored in the apertures 116,122 and are pivotable with respect to the mouthpiece members 114,120.

The bit 110 of FIG. 3 further differs from the bit 10 of FIG. 1 in the design of the joining system 126 which connects the mouthpiece members 114,120 to each other. The joining system 126 includes a ring or annular element 128 which is of one piece with the longitudinal end 114*a* of the mouthpiece member 114 and a second ring or annular element 128 which is of one piece with the longitudinal end 120*a* of the mouthpiece member 120. The rings 128 can be identical to the ring 28 of FIG. 1.

The joining system 126 additionally includes an intermediate mouthpiece member 136 which is located between the mouthpiece members 114,120. The intermediate mouthpiece member 136 comprises a central mounting part 136*a* and two rings or annular members 130 which are fast with the mounting part 136*a* and project to diametrically opposite sides thereof. Each of the rings 130 adjoins a respective ring 128.

Each of the rings 128 comprises an at least approximately annular rod-like or bar-like portion 132 which runs circumferentially of the respective ring 128 and defines a circular opening 128*a*. Similarly, each of the rings 130 comprises an at least approximately annular rod-like or bar-like portion 134 which runs circumferentially of the respective ring 130 and defines a circular opening 130*a*. The annular portion 132 of each ring 128 passes through the opening 130*a* in the adjoining ring 130 while the annular portion 134 of each ring 130 passes through the opening 128*a* in the adjoining ring 128. Thus, the rings 128 are interlocked with the adjoining rings 130.

The rings 128 are symmetrical or nearly so. Thus, the annular portion 132 of each ring 128 has a uniform diameter or thickness along the entire, or almost the entire, circumference of the respective ring 128. Hence, the opening 128*a* in each ring 128 is centered, or nearly centered, in the ring 128. The diameter or thickness of the annular portion 132 of each ring 128 is smaller than the diameter or maximum width of the opening 130*a* in the respective ring 130. This allows the rings 128 to pivot or rotate relative to the adjoining rings 130.

In contrast to the rings 128, the rings 130 are asymmetrical like the ring 30 of FIGS. 1 and 2. Similarly to the ring 30, the diameter or thickness of the annular portion 134 of each ring 130 varies circumferentially of the respective ring 130. Depending upon the orientation of a ring 130, the diameter or thickness of the annular portion 134 of the ring 130 increases progressively from a minimum to a maximum when proceeding clockwise or counterclockwise around the ring 130. Accordingly, the openings 130*a* of the rings 130 are off-center in the respective rings 130.

The annular portion 134 of each ring 130 includes a thinner section 134*a* which runs partway along the circumference of the respective ring 130 and a thicker section 134*b* which also runs partway along the circumference of the respective ring 130. The diameter or thickness of an annular portion 134 everywhere along the corresponding thinner section 134*a* is smaller than the diameter or width of the opening 128*a* in the adjoining ring 128. On the other hand, the diameter or thickness of the annular portion 134 everywhere along the corresponding thicker section 134*b* is equal to or greater than the diameter or width of the opening 128*a* in the adjoining ring 128. By virtue of this design of the rings 130, each of the rings 128 can pivot or rotate relative to the respective ring 130 as long as the ring 128 is not urged against the thicker section 134*b* of the ring 130. In contrast, when a ring 128 is urged into abutment with a thicker section 134*b*, relative rotation of the ring 128 and its adjoining ring 130 is prevented.

The thinner sections 134*a* of the rings 130 constitute, or constitute part of, a pivot system or pivot means for pivoting or rotating the two rings 128, as well as two adjoining rings 128,130, relative to each other. On the other hand, the thicker sections 134*b* constitute, or constitute part of, a stop system or stop means for preventing or limiting relative pivoting or rotation of the two rings 128 and relative pivoting or rotation of two adjoining rings 128,130.

In FIG. 3, the bit 110 is assumed to be located in the mouth of a horse. When the bit 110 is properly positioned in the mouth of the horse as in FIG. 3, both of the rings 130 have a generally horizontal orientation and the thicker sections 134*b* of the rings 130 face the rear of the horse.

FIG. 3 shows the mouthpiece 112 of the bit 110 in a reference position in which the longitudinal end 114*a* of the mouthpiece member 114, the longitudinal end 120*a* of the mouthpiece member 120, the rings 128 and the rings 130 lie at least approximately along a straight line.

The bit 110 operates similarly to the bit 10 of FIG. 1. From the reference position, the mouthpiece members 114,120 can pivot relative to one another through a substantial angle towards the front of the horse as indicated by the arrows A. On the other hand, relative pivotal movement of the mouthpiece members 114,120 from the reference position towards the rear of the horse, denoted by the arrows B, is restricted by the stop system including the thicker sections 134*b* of the rings 130. The maximum possible relative angular displacement of the mouthpiece members 114,120 towards the rear of the horse is at most a minor fraction of the maximum possible relative angular displacement towards the front of the horse.

With slack reins, the mouthpiece members 114,120 of the mouthpiece 112 can pivot relative to each other through a substantial angle from the reference position towards the front of the horse. Hence, the mouthpiece 112 resembles a conventional jointed mouthpiece in that any discomfort to the horse caused by the mouthpiece 112 can be reduced. When the reins are taut and the rings 128 are pulled against the thicker sections 134*b* of the respective rings 130, the mouthpiece 112 feels like a rigid mouthpiece to the horse.

Figure 4:
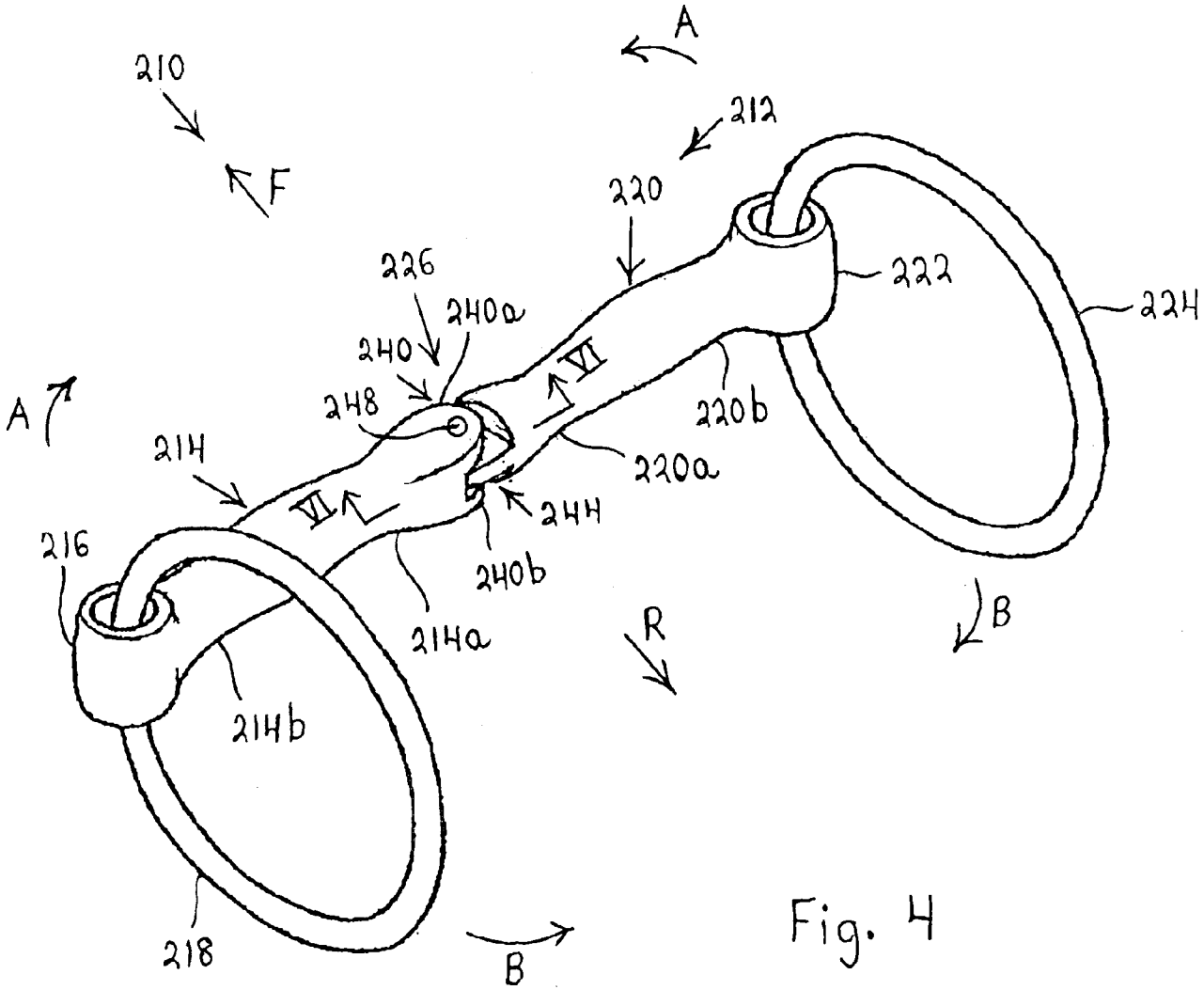
FIG. 4 is a perspective view of a bit containing a further embodiment of a mouthpiece according to the invention.
Figure 5:
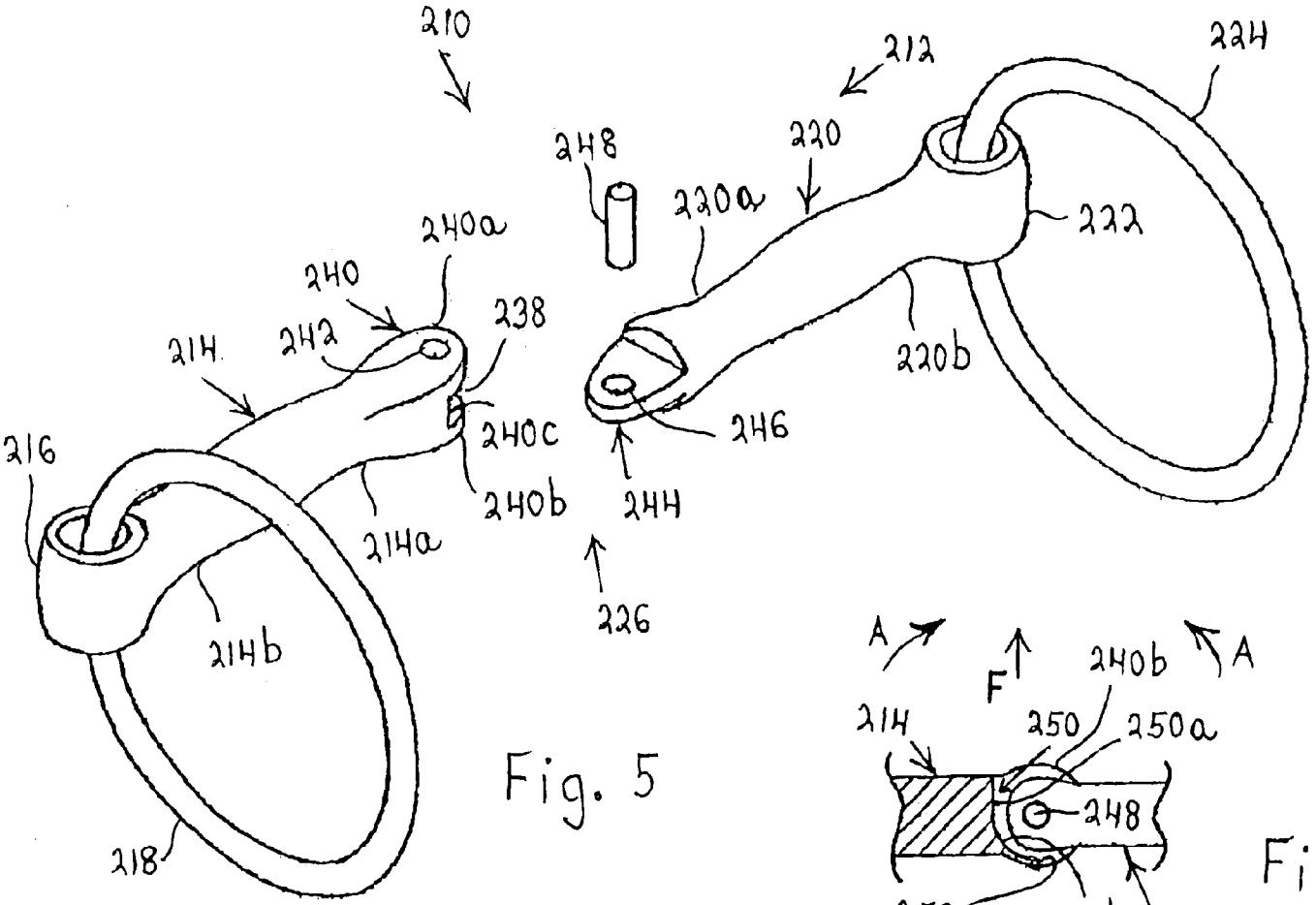
FIG. 5 is a partially exploded perspective view of the bit of FIG. 4.
Figure 6:
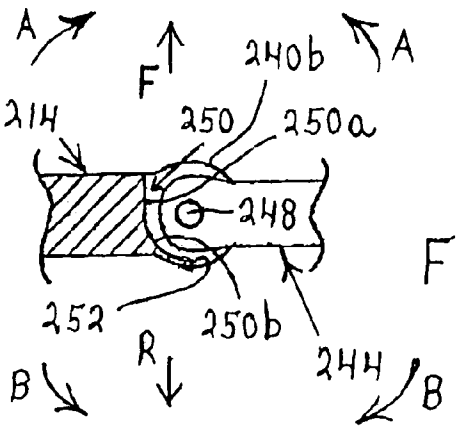
FIG. 6 is a fragmentary sectional view in the direction of the arrows VI—VI of FIG. 4.

FIGS. 4–6 illustrate a further embodiment of a bit according to the invention. In FIGS. 4–6, the same letters as in FIG. 1 have the same meaning. Moreover, the same numerals as in FIG. 1, plus 200, denote similar elements.

The bit 210 shown in FIG. 4 differs from the bit 10 of FIG. 1 in certain respects. Thus, the mouthpiece members 214, 220 of the bit 210 are shaped somewhat differently than the mouthpiece members 14,20 of the bit 10. Furthermore, the cheeks 218,224 of the bit 210 have different configurations than the cheeks 18,24 of the bit 10 and the tubes 216,222 which anchor the cheeks 218,224 are shorter than the tubes 16,22 which anchor the cheeks 18,24.

The bit 210 of FIG. 4 additionally differs from the bit 10 of FIG. 1 in the design of the joining system 226 for connecting the mouthpiece members 214,220 to one another. Considering FIG. 5 in conjunction with FIG. 4, it will be observed that the longitudinal end 214*a* of the mouthpiece member 214 is provided with a slot or cutout 238 which causes a U-shaped element 240 to be formed at the end 214*a*. The U-shaped element 240 includes two parallel legs 240*a* and 240*b* which bound the slot 238 on two opposite sides. Each of the legs 240*a*,240*b* has a free end which faces the mouthpiece member 220, and the U-shaped element 240 opens towards the member 220. Each of the legs 240*a*,240*b* has another end remote from the free end thereof, and such other ends are bridged by an end face 240*c* of the mouthpiece member 214.

The leg 240*a* of the U-shaped element 240 is provided with an opening 242 having an axis which passes through the slot 238, and the leg 240*b* is provided with a non-illustrated opening in register with the opening 242. A tongue or projection 244 extends from the longitudinal end 220*a* of the mouthpiece member 220 into the slot 238 and is formed with an opening 246. The opening 246 registers with the opening 242 in the leg 240*a* and with the non-illustrated opening in the leg 240*b*. A pivot pin 248 traverses the slot 238 and is fixed in the opening 242 and the registering non-illustrated opening of the leg 240*b*. On the other hand, the diameter of the pin 248 is smaller than the diameter of the opening 246 in the tongue 244 so that the tongue 244 can pivot or rotate on the pivot pin 248. Accordingly, the U-shaped element 240 and the tongue 244 are pivotable or rotatable with respect to each other. The pivot pin 248 constitutes, or constitutes part of, a pivot system or pivot means for pivoting or rotating the mouthpiece members 214,220 relative to one another.

Referring to FIG. 6, the surface of the leg 240*b* which faces the leg 240*a* is provided with a shoulder or step 250. The shoulder 250 includes a straight segment 250*a* which extends from one side of the leg 240*b* partway across the latter, and the shoulder 250 further includes a curved segment 250*b* which extends from the straight segment 250*a* to the other side of the leg 240*b*. The curved segment 250*b* has a free end remote from the straight segment 250*a*, and the free end of the curved segment 250*b* is provided with an edge 252 constituting an abutment.

The tongue 244 projects from the mouthpiece member 220 to a location beyond the abutment edge 252 of the shoulder 250. The tongue 244 has a free end portion remote from the mouthpiece member 220, and the free end portion of the tongue 244 confronts the shoulder 250.

In FIGS. 4 and 6, the bit 210 is assumed to be located in the mouth of a horse. When the bit 210 is properly positioned in the mouth of the horse as in FIGS. 4 and 6, the legs 240*a*,240*b* of the U-shaped element 240, as well as the tongue 244, have a generally horizontal orientation and the abutment edge 252 of the shoulder 250 is situated between the free end of the tongue 244 and the rear of the horse.

FIGS. 4 and 6 show the mouthpiece 212 of the bit 210 in a reference position in which the longitudinal end 214*a* of the mouthpiece member 214, the longitudinal end 220*a* of the mouthpiece member 220, the pivot pin 248, the shoulder 250 and the free end portion of the tongue 244 lie at least approximately along a straight line.

The free end portion of the tongue 244 is curved similarly to the curved segment 250*b* of the shoulder 250. In the reference position, a gap exists between the shoulder 250 and the free end portion of the tongue 244.

When the mouthpiece members 214,220 are urged towards the front of the horse per the arrows A, a gap will remain between the shoulder 250 and the tongue 244 because the curved segment 250*b* of the shoulder 250 and the free end portion of the tongue 244 have similar curvatures and the curved segment 250*b* tends to rotate around the free end portion of the tongue 244. Accordingly, the mouthpiece members 214,220 can pivot relative to one another through a substantial angle towards the front of the horse. This angle can be of the order of 180 degrees. On the other hand, when the mouthpiece members 214,220 are urged towards the rear of the horse per the arrows B, the abutment edge 252 of the shoulder 250 and the tongue 244 approach one another. After limited relative pivotal movement and angular displacement of the mouthpiece members 214,220, the abutment edge 252 and the tongue 244 come into contact and prevent further relative pivotal movement and angular displacement of the mouthpiece members 214,220 towards the rear of the horse. The relative angular displacement which the mouthpiece members 214,220 can undergo towards the rear of the horse is a minor fraction of the maximum possible relative angular displacement towards the front of the horse. For example, the maximum possible relative angular displacement of the mouthpiece members 214,220 towards the rear of the horse can be 45 degrees.

Although the shoulder 250 is here designed to permit limited relative pivotal movement of the mouthpiece members 214,220 towards the rear of the horse, the shoulder 250 could be designed to prevent any relative pivotal movement in this direction.

The tongue 244 and the shoulder 250 constitute, or constitute part of, a stop system or stop means for preventing or limiting relative pivoting or rotation of the mouthpiece members 214,220.

With slack reins, the mouthpiece members 214,220 of the mouthpiece 212 have substantial freedom to pivot relative to each other from the reference position towards the front of the horse. Consequently, similarly to a conventional jointed mouthpiece, the mouthpiece 212 can adjust to reduce any discomfort which the horse may experience from the bit 210. In contrast, when the reins are taut and the tongue 244 and abutment edge 252 of the shoulder 250 are urged against one another, the mouthpiece 212 acts like a rigid mouthpiece.

Figure 7:
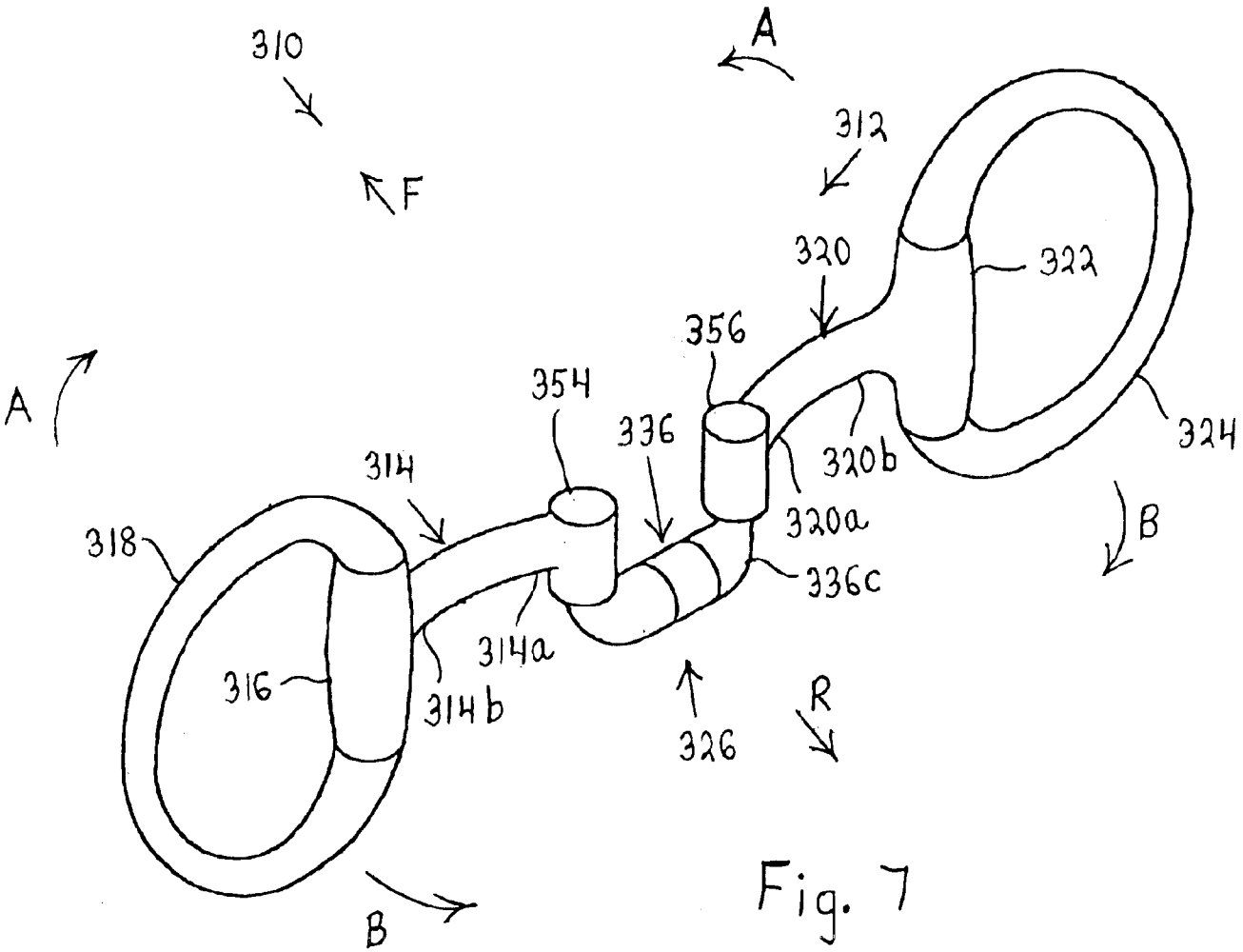
FIG. 7 is a perspective view of a bit containing an additional embodiment of a mouthpiece in accordance with the invention.
Figure 8:
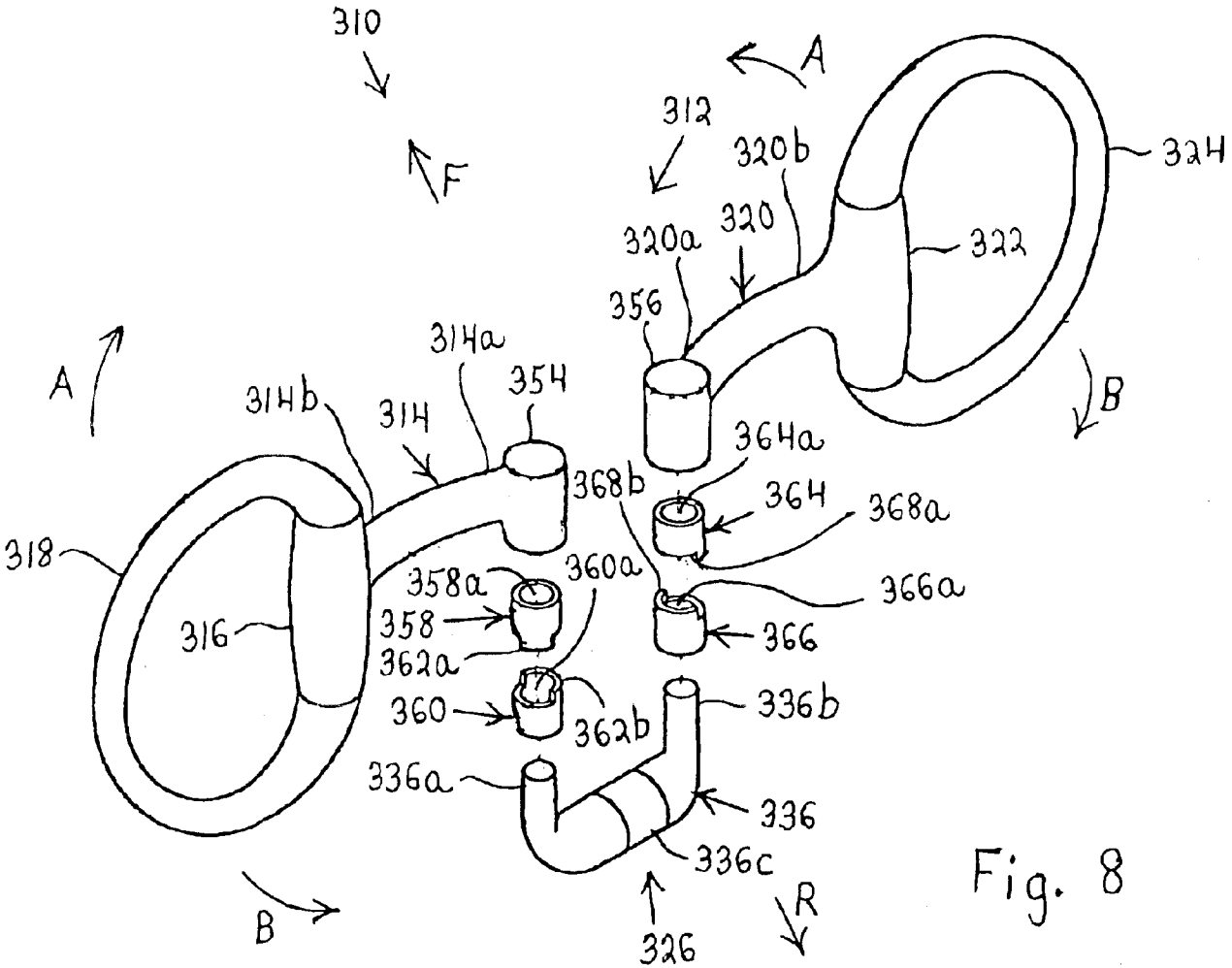
FIG. 8 is a partially exploded perspective view of the bit of FIG. 7.

With reference to FIGS. 7 and 8, which illustrate an additional embodiment of a bit in accordance with the invention, the same letters as in FIG. 1 have the same meaning. Furthermore, the same numerals as in FIG. 1, plus 300, identify similar elements.

The bit 310 of FIGS. 7 and 8 differs from the bit 10 of FIG. 1 in several respects. Thus, the mouthpiece members 314,320 of the bit 310 have slightly different configurations than the mouthpiece members 14,20 of the bit 10. Moreover, the cheeks 318,324 of the bit 310 are shaped differently than the cheeks 18,24 of the bit 10.

The bit 310 of FIGS. 7 and 8 also differs from the bit 10 of FIG. 1 in the design of the joining system 326 for connecting the ends 314*a*,320*a* of the mouthpiece members 314,320 to each other.

The joining system 326 comprises a tubular or hollow cylindrical element 354 of one piece with the longitudinal end 314*a* of the mouthpiece member 314 and a tubular or hollow cylindrical element 356 of one piece with the longitudinal end 320*a* of the mouthpiece member 320. The mouthpiece members 314,320 are elongated and have respective longitudinal axes, and each of the tubular elements 354,356 has a longitudinal axis which extends transverse to the longitudinal axis of the associated mouthpiece member 314,320. The longitudinal axes of the tubular elements 354,356 can be perpendicular, or approximately perpendicular, to the longitudinal axes of the respective mouthpiece members 314,320.

Each of the tubular elements 354,356 is provided with a passage of circular cross section which runs longitudinally of the corresponding tubular element 354,356 and is open at one or both longitudinal ends of the tubular element 354, 356. In FIGS. 7 and 8 where the tubular elements 354,356 and their passages are generally vertical, at least the lower end of each passage and each tubular element 354,356 is open.

The joining system 326 further comprises an intermediate mouthpiece member 336 which is located between the mouthpiece members 314,320. The intermediate mouthpiece member 336 is U-shaped and has two parallel legs 336*a* and 336*b* which are joined to one another by a crosspiece 336*c*. The legs 336*a*,336*b* are in the form of short shafts having circular cross sections, and the diameters of the shafts 336*a*,336*b* are smaller than the diameters of the passages in the tubular elements 354,356.

The joining system 326 additionally comprises an annular element 358 having a central channel 358*a* of circular cross section and an annular element 360 likewise having a central channel 360*a* of circular cross section. The annular elements 358,360 are located next to one another in the passage of the tubular element 354 with the central channels 358*a*,360*a* in alignment with each other. The shaft 336*a* of the intermediate mouthpiece member 336 passes through the lower end of the tubular element 354 and projects into the central channels 358*a*,360*a* of the annular elements 358,360. The annular element 360 is disposed between the annular element 358 and the crosspiece 336*c* of the intermediate mouthpiece member 336.

The annular element 358 is a friction fit in the passage of the tubular element 354 and thus pivots or rotates as a unit with the tubular element 354 and the mouthpiece member 314. On the other hand, the annular element 360 fits in the passage of the tubular element 354 with clearance so that the tubular element 354 can pivot or rotate relative to the annular element 360.

The shaft 336*a* of the intermediate mouthpiece member 336 fits in the central passage 358*a* of the annular element 358 with clearance. This allows the annular element 358 to pivot or rotate relative to the shaft 336*a*. In contrast, the annular element 360 is a friction fit on the shaft 336*a* thereby causing the annular element 360 to be fixed relative to the tubular element 354 and the annular element 358.

The end of the annular element 358 which faces the annular element 360 is provided with a tab or protrusion 362*a*. Similarly, the end of the annular element 360 which faces the annular element 358 is provided with a tab or protrusion 362*b*. When the tab 362*a* is pivoted or rotated through a sufficiently large angle either counterclockwise or clockwise, the tab 362*a* comes into abutment with the tab 362*b* and additional pivoting or rotation of the tab 362*a* in the respective direction is prevented. Thus, the tabs 362*a*, 362*b* function to prevent or limit pivoting or rotation of the mouthpiece member 314.

The joining system 326 also comprises an annular element 364 having a central channel 364*a* of circular cross section and an annular element 366 likewise having a central channel 366*a* of circular cross section. The annular elements 364,366 are located next to one another in the passage of the tubular element 356 with the central channels 364*a*,366*a* in alignment with each other. The shaft 336*b* of the intermediate mouthpiece member 336 passes through the lower end of the tubular element 356 and projects into the central channels 364*a*,366*a* of the annular elements 364,366. The annular element 366 is disposed between the annular element 364 and the crosspiece 336*c* of the intermediate mouthpiece member 336.

The annular element 364 is a friction fit in the passage of the tubular element 356 and thus pivots or rotates as a unit with the tubular element 356 and the mouthpiece member 320. On the other hand, the annular element 366 fits in the passage of the tubular element 356 with clearance so that the tubular element 356 can pivot or rotate relative to the annular element 366.

The shaft 336*b* of the intermediate mouthpiece member 336 fits in the central passage 364*a* of the annular element 364 with clearance. This allows the annular element 364 to pivot or rotate relative to the shaft 336*b*. In contrast, the annular element 366 is a friction fit on the shaft 336*b* thereby causing the annular element 366 to be fixed relative to the tubular element 356 and the annular element 364.

The end of the annular element 364 which faces the annular element 366 is provided with a tab or protrusion 368*a*. Similarly, the end of the annular element 366 which faces the annular element 364 is provided with a tab or protrusion 368*b*. When the tab 368*a* is pivoted or rotated through a sufficiently large angle either counterclockwise or clockwise, the tab 368*a* comes into abutment with the tab 368*b* and additional pivoting or rotation of the tab 368*a* in the respective direction is prevented. Thus, the tabs 368*a*, 368*b* function to prevent or limit pivoting or rotation of the mouthpiece member 320.

By way of example, the intermediate mouthpiece member 336 can be held in place on the bit 310 by two non-illustrated bolts which respectively pass through the ends of the tubular elements 354,356 opposite those through which the shafts 336*a*,336*b* of the intermediate mouthpiece member 336 enter the tubular elements 354,356. Such bolts may be screwed into the shafts 336*a*,336*b*.

In FIG. 7, the bit 310 is assumed to be located in the mouth of a horse. When the bit 310 is properly positioned in the mouth of the horse as in FIG. 7, the tubular elements 354,356 and the legs 336*a*,336*b* of the intermediate mouthpiece member 336 are generally vertical. Moreover, the crosspiece 336*c* of the intermediate mouthpiece member 336 is disposed below the tubular elements 354,356.

FIG. 7 shows the mouthpiece 312 of the bit 310 in a reference position in which the longitudinal end 314*a* of the mouthpiece member 314, the longitudinal end 320*a* of the mouthpiece member 320, the tubular elements 354,356, the annular elements 358,360,364,366 and the legs 336*a*,336*b* of the intermediate mouthpiece member 336 lie approximately along a straight line.

Considering FIG. 8, the distance between the tabs 362*a*, 362*b* counterclockwise of the annular elements 358,360 is smaller than the distance clockwise of the elements 358,360 when the mouthpiece 312 is in the reference position. Hence, the mouthpiece member 314 can pivot or rotate to the front of the horse per the clockwise arrow A through a larger angle than to the rear of the horse per the counterclockwise arrow B. In contrast, the distance between the tabs 368*a*,368*b* counterclockwise of the annular elements 364, 366 is larger than the distance clockwise of the elements 364,366. Accordingly, the mouthpiece member is able to pivot to the front of the horse per the counterclockwise arrow A through a larger angle than to the rear of the horse per the clockwise arrow B. The maximum possible angular displacements of the mouthpiece members 314,320 from the reference position will depend upon the circumferential lengths of the tabs 362*a*,362*b*,368*a*,368*b* and the circumferential distances between the tabs 362*a*,362*b* and 368*a*,368*b* in the reference position. However, in any event, the maximum possible relative angular displacement of the mouthpiece members 314,320 from the reference position towards the rear of the horse will be at most a minor fraction of the maximum possible relative angular displacement from the reference position towards the front of the horse.

The tubular elements 354,356 and the shafts 336*a*,336*b* of the intermediate mouthpiece member 336 constitute, or constitute part of, a pivot system or pivot means for pivoting or rotating the mouthpiece members 314,320 relative to one another. On the other hand, the annular elements 358,360, 364,366 and the tabs 362*a*,362*b*,368*a*,368*b* constitute, or constitute part of, a stop system or stop means for preventing or limiting relative rotation of the mouthpiece members 314,320 towards the rear of the horse.

As long as the reins are slack, the mouthpiece members 314,320 of the mouthpiece 312 are free to pivot relative to one another through a substantial angle from the reference position towards the front of the horse. Like a conventional jointed mouthpiece, this makes it possible to reduce any discomfort which the mouthpiece 312 may cause the horse. In contrast, when the reins are pulled taut so that the tab 362*a* abuts the tab 362*b* and the tab 368*a* abuts the tab 368*b*, the mouthpiece 312 has the feel of a rigid mouthpiece for the horse.

The mouthpiece members 14,20,114,120,136,214,220, 314,320,336 can be fabricated using techniques such as forging and casting. Per the showing in FIGS. 7 and 8, the intermediate mouthpiece member 336 may be assembled from two L-shaped sections and a cylindrical section which are bonded, e.g., welded, to one another.

Regarding the bit 10 of FIG. 1, the mouthpiece member 14 and the ring 28 may be fashioned from the same body of material as the mouthpiece member 14 in the same fabricating procedure. Similarly, the mouthpiece member 20 and the ring 30 may be produced from the same body of material during the same production process. It is possible to interlock the rings 28,30 as part of the operation of fashioning the rings 28,30.

The tubes 16,22 can be sections of tubular material which have been shaped to the desired contours and then bonded, e.g., welded, to the respective mouthpiece members 14,20. The cheeks 18,24 may be forged or cast pieces which are mounted on the corresponding tubes 16,22 for pivotal movement relative thereto.

With respect to the bit 110 of FIG. 3, the mouthpiece member 114 and its ring 128 can be produced from the same body of material during the same fabricating procedure. Likewise, the mouthpiece member 120 and the associated ring 128 can be fashioned from the same body of material in the same production process. In a similar vein, the rings 130 and mounting part 136*a* of the intermediate mouthpiece member 136 may be made from the same body of material during the same manufacturing operation. The process of forming the rings 128,130 can include interlocking each of the rings 130 with a respective ring 128.

After the mouthpiece members 114,120 have been formed, the aperture 116 may be drilled into the mouthpiece member 114 and the aperture 122 into the mouthpiece member 120. The cheeks 118,124 can be produced from sections of rod material which are passed through the apertures 116,122 and bent so that the two ends of each section adjoin one another. The two ends of each section may thereupon be bonded, e.g., welded, to each other.

1Considering the bit 210 of FIGS. 4–6, the tongue 244 on the mouthpiece member 220 can be machined from the body of material used to make the mouthpiece member 220 following production of the mouthpiece member 220. The U-shaped element 240 on the mouthpiece member 214 can be generated, after the mouthpiece member 214 has been formed, by machining the slot 238 into the body of material used to make the mouthpiece member 214. The shoulder 250 may be produced by milling the leg 240*b* of the U-shaped element 240 once the slot 238 has been machined.

The opening 242 in the leg 240*a* of the U-shaped element 240 and the registering non-illustrated opening in the leg 240*b* of the U-shaped element 240 can be formed either before or after the U-shaped element 240 is fashioned. Thus, prior to cutting the slot 238, it is possible to form the opening 242 in the leg 240*a* and the registering non-illustrated opening in the leg 240*b* by drilling a passage through the mass of material which is to be machined so as to generate the U-shaped element 240. However, the opening 242 in the leg 240*a* and the registering non-illustrated opening in the leg 240*b* can also be formed by drilling through the legs 240*a*,240*b* after the slot 238 has been cut. The opening 246 in the tongue 244 may be produced by drilling through the tongue 244. The pivot pin 248 which links the U-shaped element 240 and the tongue 244 can be fashioned by forging or casting.

When the pivot pin 248, the tongue 244 with its opening 246 and the U-shaped element 240 with the opening 242 and the registering non-illustrated opening have been produced, the tongue 244 is inserted in the slot 238. The opening 246 in the tongue 244 is then aligned with the opening 242 and the registering non-illustrated opening in the U-shaped element 240. Once the opening 246, the opening 242 and the registering non-illustrated opening are in alignment, the pivot pin 248 is passed through the opening 242, the opening 246 and the registering non-illustrated opening. The pivot pin 248 passes through the opening 246 of the tongue 244 with clearance but is caused to be fixed in the opening 242 and the registering non-illustrated opening of the U-shaped element 240. Hence, the tongue 244 and the U-shaped element 240 with the shoulder 250 are mounted on the pivot pin 248 for pivoting or rotation relative to one another.

The mouthpiece member 214 and the tube 216 may be fabricated from the same body of material in the same manufacturing operation. Likewise, the mouthpiece member 220 and the tube 222 can be fashioned from the same body of material during the same production process. However, it is also possible to cut the tubes 216,222 from a discrete length of tubular material and bond, e.g., weld, the tubes 216,222 to the respective mouthpiece members 214,220.

The cheeks 218,224 can be produced from sections of rod material which are passed through the tubes 216,222 and bent so that the two ends of each section adjoin one another. The two ends of each section may thereupon be bonded, e.g., welded, to each other.

Referring to the bit 310 of FIGS. 7 and 8, the mouthpiece member 314 and the tubular element 354 may be formed from the same body of material. Furthermore, the tubular element 354, absent the non-illustrated passage therein which is drilled subsequently, can be fashioned in the same production process as the mouthpiece member 314. The mouthpiece member 320 and the tubular element 356 may also be made from the same body of material. Moreover, the tubular element 356, minus the non-illustrated passage which is drilled into the tubular element 356 later, may be produced during the same fabricating procedure as the mouthpiece member 320.

The annular elements 358,360,364,366 and the respective tabs 362*a*,362*b*,368*a*,368*b* may be produced by casting. It is also possible to fashion the annular elements 358,360,364, 366 by cutting four sections from a length of tubular material and then machining these sections to form the tabs 362*a*, 362*b*,368*a*,368*b*.

Once the intermediate mouthpiece member 336, the tubular elements 354,356, the annular elements 358,360,364,366 and the tabs 362*a*,362*b*,368*a*,368*b* have been formed, the annular elements 360,366 are respectively press fit on the shafts 336*a*,336*b* of the intermediate mouthpiece member 336 with the tabs 362*b*,368*b* facing away from the crosspiece 336*c*. The annular element 358 is then placed on the shaft 336*a* adjacent to the annular element 360 with the tab 362*a* on the annular element 358 facing the annular element 360. Similarly, the annular element 364 is placed on the shaft 336*b* with adjacent to the annular element 366 with the tab 368*a* of the annular element 364 facing the annular element 366. The shafts 336*a*,336*b* are thereupon pushed into the non-illustrated passages of the respective tubular elements 354,356. This causes the annular element 358 to be press fit in the tubular element 354 and the annular element 364 to be press fit in the tubular element 356. Since the outer diameter of the annular element 360 on the shaft 336*a* is smaller than the diameter of the passage in the tubular element 354, the tubular element 354 and the shaft 336*a* are pivotable or rotatable relative to one another. In a like vein, inasmuch as the outer diameter of the annular element 366 on the leg 336*b* is smaller than the diameter of the passage in the tubular element 356, the tubular element 356 and the shaft 336*b* can pivot or rotate relative to each other.

The tubes 316,322 can be sections of tubular material which have been shaped to the desired contours and then bonded, e.g., welded, to the respective mouthpiece members 314,320. The cheeks 318,324 may be forged or cast pieces which are mounted on the corresponding tubes 316,322 for pivotal movement relative thereto.

As mentioned previously, the bit 10 or 110 or 210 or 310 can be used to ease the transition from a bit with a conventional jointed mouthpiece to a bit with a conventional, completely rigid mouthpiece. In addition, during competition, the stop system including the thicker section 34*b* of the bit 10, or the thicker section 134*b* of the bit 110, or the tongue 244 and shoulder 250 of the bit 210, or the annular elements 358,360,364,366 and tabs 362*a*,362*b*, 368*a*,368*b* of the bit 310 is more effective for dressage and allows a rider to stop and turn a horse more quickly.

Various modifications are possible within the meaning and range of equivalence of the appended claims.

We claim:

1. An equestrian mouthpiece Comprising:

a first member for insertion in the mouth of a horse, said first member having a first end;

a second member for insertion in the mouth of a horse, said second member having a second end; and means for joining said first end and said second end to one another, said joining means including pivot means mounting said members for pivotal movement relative to each other in a first direction from a position in which said joining means and said ends lie substantially along a straight line, and said joining means further including stop means for preventing or limiting relative pivotal movement of said members from said position in a second direction opposite to said first direction, said stop means being designed so that relative angular displacement of said members from said position in said second direction is restricted to at most a minor fraction of the maximum possible relative angular displacement of said members from said position in said first direction, and said joining means including a ring-shaped first element which defines an opening and a ring-shaped second element which passes through said opening, said opening having a maximum width, and said second element comprising a first section which constitutes part of said pivot means and has a thickness smaller than said maximum width and a second section which constitutes part of said stop means and has a thickness greater than said maximum width.

2. The mouthpiece of claim 1, further comprising a pair of cheeks for attachment to reins; and wherein said first member and said second member are each of one piece, said first member having an additional first end and said second member having an additional second end, and one of said cheeks being mounted at each of said additional ends, part of said joining means being of one piece with said first member and the remainder of said joining means being of one piece with said second member.

3. The mouthpiece of claim 1, wherein said joining means comprises an additional member between said first member and said second member, one of said first element and said second element being provided on said first member and the other of said first element and said second element being provided on said additional member.

4. The mouthpiece of claim 3, wherein said joining means comprises a first additional element which defines an additional opening and a second additional element which passes through said additional opening, said additional opening having an additional maximum width, and said second additional element including a first section which constitutes part of said pivot means and has a thickness smaller than said additional maximum width and a second section which constitutes part of said stop means and has a thickness greater than said additional maximum width, one of said first additional element and said second additional element being provided on said second member and the other of said first additional element and said second additional element being provided on said additional member.

5. The mouthpiece of claim 4, wherein said additional elements are ring-shaped.

6. An equestrian mouthpiece comprising:

a first member for insertion in the mouth of a horse, said first member having a first end;

a second member for insertion in the mouth of a horse, said second member having a second end; and means for joining said first end and said second end to one another, said joining means including pivot means mounting said members for pivotal movement relative to each other in a first direction from a position in which said joining means and said ends lie substantially along a straight line, and said joining means further including stop means for preventing or limiting relative pivotal movement of said members from said position in a second direction opposite to said first direction, said stop means being designed so that relative angular displacement of said members from said position in said second direction is restricted to at most a minor fraction of the maximum possible relative angular displacement of said members from said position in said first direction, and said stop means comprising a pair of protrusions movable relative to and into abutment with one another, said pivot means including a tubular element and a shaft extending into said tubular element, and one of said protrusions being fast with said tubular element and the other of said protrusions being fast with said shaft.

7. The mouthpiece of claim 6, wherein said stop means comprises a first cylindrical element and a second cylindrical element, said first cylindrical element being fast with and located inside said tubular element, and said second cylindrical element receiving said shaft and being fast therewith, one of said protrusions being provided on said first cylindrical element and the other of said protrusions being provided on said second cylindrical element.

8. The mouthpiece of claim 6, wherein said joining means comprises an additional member between said first member and said second member, said tubular element being provided on one of said first member and said additional member and said shaft being provided on the other of said first member and said additional member.

9. The mouthpiece of claim 8, wherein said stop means comprises a pair of additional protrusions movable relative to and into abutment with one another, said pivot means including an additional tubular element fast with one of said additional protrusions and an additional shaft extending into said additional tubular element and fast with the other of said additional protrusions, said additional tubular element being located on one of said second member and said additional member and said additional shaft being located on the other of said second member arid said additional member.

10. An equestrian mouthpiece comprising:

a first member for insertion in the mouth of a horse, said first member being of one piece and having a first end and one additional end;

a second member for insertion in the mouth of a horse, said second member being of one piece and having a second end and another end;

a pair of cheeks for attachment to reins, one of said cheeks being mounted at said one additional end and the other, of said cheeks being mounted at said another end; and means for joining said first end and said second end to one another, said joining means including pivot means mounting said members for pivotal movement relative to each other in a first direction from a position in which maid joining means, said first end and said second end lie substantially along a straight line, and said joining means further including stop means for preventing or limiting relative pivotal movement of said members from said position in a second direction opposite to said first direction, said stop means being designed so that relative angular displacement of said members from said position in said second direction is restricted to at most a minor fraction of the maximum possible relative angular displacement of said members from said position in maid first direction, and part of said joining means being of one piece with said first member and the remainder of said joining means being of one piece with said second member, said joining means comprising a ring-shaped first element which is of one piece with said first member and defines an opening, and said joining means additionally a ring-shaped second element which is of one piece with said second member and passes through said opening.

* * * * *

UNITED STATES PATENT AND TRADEMARK OFFICE

CERTIFICATE OF CORRECTION

PATENT NO. : 6,848,242 B2 
DATED : February 1, 2005
INVENTOR(S) : Hsi-Chang Chang, Nelson Pessoa and Rodrigo Pessoa It is certified that error appears in the above-identified patent and that said Letters Patent is hereby corrected as shown below:

Title page,
Item [76], Inventors, "Rodrigo Fessca" should read -- Rodrigo Pessoa --

Column 20,
Lines 2 and 12, change "maid" to -- said --;
Line 18, after "additionally" insert -- comprising --

Signed and Sealed this

Thirty-first Day of May, 2005

JON W. DUDAS
*Director of the United States Patent and Trademark Office*